US006005527A

United States Patent [19]

Gomez et al.

[11] Patent Number: 6,005,527

[45] Date of Patent: Dec. 21, 1999

[54] RF COUPLER FOR CONCEALED MOBILE TELECOMMUNICATIONS SYSTEMS UTILIZING WINDOW-MOUNTED ANTENNAS AND SYSTEMS USING SAME

[75] Inventors: Francisco X. Gomez, Melrose Park, Ill.; Peter Fink, Ann Arbor, Mich.; Joseph F. Mockus, North Riverside; Kevin M. Campbell, Des Palines, both of Ill.

[73] Assignee: Andrew Corporation, Itasca, Ill.

[21] Appl. No.: 08/891,281

[22] Filed: Jul. 10, 1997

[51] Int. Cl.[6] ..... H01Q 1/32

[52] U.S. Cl. ..... 343/713; 343/906; 343/711

[58] Field of Search ..... 343/713, 906, 343/715, 711, 712, 714; 439/916; H01Q 1/32

[56] References Cited

U.S. PATENT DOCUMENTS

| | | | |
|---|---|---|---|
| Re. 33,743 | 11/1991 | Blaese | 343/715 |
| 3,818,489 | 6/1974 | Bobel, II et al. | 343/713 |
| 4,086,595 | 4/1978 | Cherenko et al. | 343/713 |
| 4,089,817 | 5/1978 | Kirkendall | 343/713 |
| 4,721,964 | 1/1988 | Sato et al. | 343/713 |
| 4,839,660 | 6/1989 | Hadzoglou | 343/715 |
| 4,862,183 | 8/1989 | Blaese | 343/715 |
| 4,873,532 | 10/1989 | Sakurai et al. | 343/713 |
| 4,914,447 | 4/1990 | Ishii et al. | 343/715 |
| 4,992,800 | 2/1991 | Parfitt | 343/713 |
| 5,099,251 | 3/1992 | Fisher | 343/715 |
| 5,220,336 | 6/1993 | Hirotsu et al. | 343/713 |
| 5,268,700 | 12/1993 | Hirotsu et al. | 343/713 |
| 5,479,179 | 12/1995 | Hirotsu et al. | 343/713 |

*Primary Examiner*—Hoanganh Le
*Attorney, Agent, or Firm*—Vedder Price Kaufman & Kammholz

[57] ABSTRACT

An RF coupler that provides an interconnection between a mobile telecommunication device and an antenna includes a housing having a threaded coaxial connection. Two antenna contacts extend outwardly from the interior of the housing and over a mounting surface thereof. The mounting surface has an adhesive layer formed on it in order to attach the coupler to a windshield in alignment with a pair of antenna contacts.

23 Claims, 2 Drawing Sheets

RF COUPLER FOR CONCEALED MOBILE TELECOMMUNICATIONS SYSTEMS UTILIZING WINDOW-MOUNTED ANTENNAS AND SYSTEMS USING SAME

BACKGROUND OF THE INVENTION

The present invention relates generally to mobile telephone communication systems, and more particularly, to such systems utilizing window-mounted antennas and coupling devices for passing radio frequency ("RF") signals therebetween.

The use of mobile telecommunication systems has increased exponentially over the past few years. These systems include the hand-held cellular telephone that may be carried by a user and they also include cellular telephones that are mounted directly to an automobile. In the latter instance, the system comprises the internally mounted telephone, an external antenna and a connector that connects the internal telephone to the external antenna.

Often this connection is effected by directly connecting, such as by soldering, the two leads of a coaxial connector to the window antenna pads. This type of direct connection is expensive because it requires time and labor, and it may be susceptible to breakage at the soldered joint. Other systems use coupling devices by which the leads of the coaxial connect are mounted in direct opposition to their respective antenna pads so that radio-frequency (RF) signals may pass through the intervening windshield glass during operation of the system. In both such connectors, often the point of location is visible in the interior of the automobile and thus, parts of the system are susceptible to theft.

Connecting devices are well known in the art. For example, U.S. Pat. No. 5,268,700, issued Dec. 7, 1993 describes a structure for connecting a telephone feedline with a window antenna. The feedline comprises a coaxial cable with inner and outer conductors that are soldered directly to the window glass; antenna elements. Two separate connecting elements are provided in this connector, one for each conductor of the coaxial cable. Soldering is expensive and prone to breakage. Additionally, this antenna requires specially formed cable holding elements to hold the coaxial cable in place. This antenna connection is also positioned on the surface of the window glass in plain view which increases the possibility of theft and vandalism by attracting attention. Still further, the soldered connection between the coaxial feedline and the antenna elements are exposed to the surrounding environment which may adversely affect the connections.

The present invention is directed to a telecommunications connecting device for use in a vehicle mobile radio communication system that overcomes the aforementioned disadvantages of the prior art. In view of the aforementioned need and the shortcomings of the prior art, it is therefore an object of the present invention to provide a mobile telecommunications connecting device for providing a connection between a windshield mounted antenna and a transceiver, such as a cellular telephone, in a manner wherein the connecting device is entirely concealed from view.

It is another object of the present invention to provide a concealed window-mounted antenna system for mobile telecommunication wherein the antenna includes vertical and horizontal radiator elements affixed to the interior of a vehicle, a coaxial feedline leading from the antenna radiator elements to a communications device and a coupler having two respective signal plates disposed in opposition and general alignment with the antenna radiator elements, the two signal plates being surrounded by an adhesive layer to thereby securely hold the signal plates against a surface of the windshield.

It is yet another object of the present invention to provide a low cost, concealed coupling device for use with mobile communication systems wherein the antenna radiating elements are applied to an interior surface of a vehicle windshield in an area completely concealed from view, the system including a coupling device for coupling a coaxial feedline to the antenna radiating elements, the coupling device having a housing, a threaded connector member for threadedly engaging a coaxial feedline, the housing having two contact elements extending out of the housing along a mounting face thereof, the housing further including an adhesive element disposed on the mounting surface, the adhesive element encompassing the coupling device contact elements and providing a means for reliably engaging the interior surface of the vehicle windshield such that the coupling device contact elements oppose or contact the antenna radiator elements to thereby provide a connection between the antenna and a telecommunications device within said vehicle.

These and other object, features and advantages of the present invention will be clearly understood through a consideration of the following detailed description.

SUMMARY OF THE INVENTION

The present invention satisfies these objects and offers beneficial advantages over prior art antenna systems and couplers.

In one principal aspect, the present invention comprises a concealed window-mounted antenna system for a vehicle that includes a plurality of horizontal and vertical antenna radiators applied to the interior surface of a vehicle windshield, the radiators being disposed on the windshield in an area concealed from view from the exterior, a coaxial feedline for interconnecting the two antenna radiators with a telecommunications device in the interior of the vehicle and a coupler for coupling the coaxial feedline to the antenna radiators so that RF signals pass between the coaxial feedline and antenna radiators, the coupler including a housing having means for connecting to the coaxial feedline, contacts disposed within the housing, the contacts being joined to the housing connecting means so as to provide an electrically continuous path from conductors of the coaxial feedline to the contacts, adhesive means disposed on the housing, preferably on a mounting surface in a manner that substantially surrounds the contacts, the adhesive means providing a means of securely attaching the coupler housing to the inner surface of the windshield.

In another aspect of the present invention, the contacts of the coupler are formed from a beryllium-copper alloy and the coupler adhesive means includes an adhesive layer having a very-high-bond adhesive that encompasses the coupler contacts so as to prevent the contacts from intermittently losing continuity with the antenna radiators due to vibrations experienced during operation of the vehicle.

In still another aspect of the present invention and as exemplified by one embodiment of the invention, the coupler includes a housing and a coaxial feedline connector element assembled thereto, the coaxial feedline connector element including a central lead which engages one of the coupler contacts, the other coupler contact engaging the coupler housing and serving as a ground of the antenna circuit.

In yet still another aspect of the present invention, the housing and coaxial feedline connector element are formed as a single piece.

In a further aspect of the present invention, the adhesive a means includes an adhesive pad applied to the mounting surface of the coupler, the adhesive pad including at least two openings formed therein, the openings surrounding the coupler contacts and permitting the coupler contacts to extend out of the coupler housing in opposition to the antenna radiators, the adhesive pad completely surrounding the coupler contacts within the perimeter of the coupler mounting surface.

In still a further aspect of the present invention, the adhesive pad includes only a single opening through which the coupler contacts extend, the adhesive pad opening being disposed entirely within the perimeter of the adhesive pad so that an adhesive contact is made between the coupler and the interior surface of the windshield entirely around the coupler contacts.

These and other objects, features and advantages of the present invention will become apparent from the following detailed description, taken in conjunction with the accompanying drawings, wherein like reference numerals refer to like parts.

BRIEF DESCRIPTION OF THE DRAWINGS

In the course of the following detailed description, reference will be frequently made to the accompanying drawings in which.

DETAILED DESCRIPTION OF THE INVENTION

Figure 1:
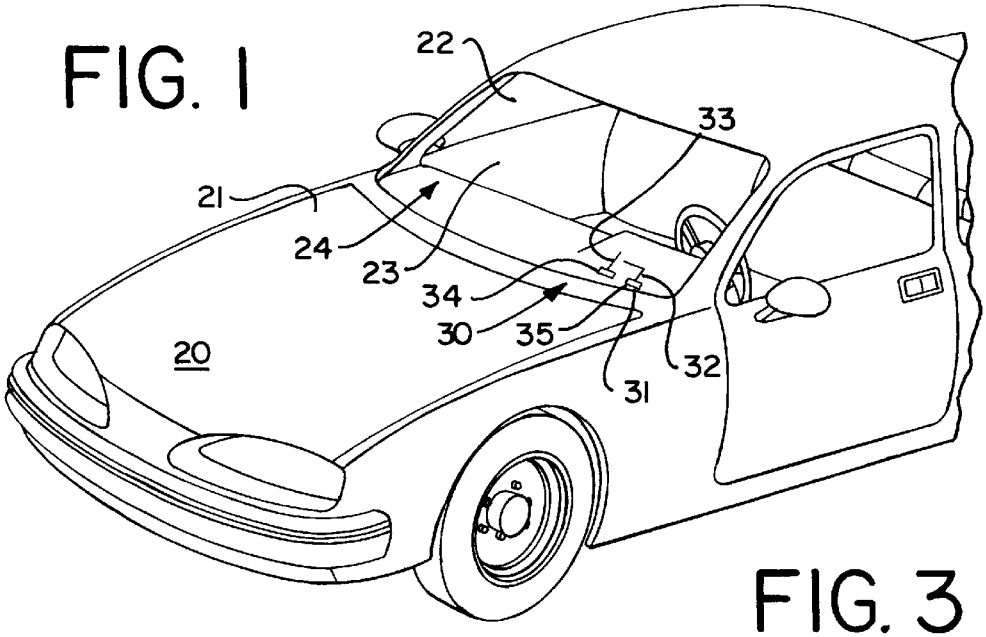
FIG. 1 is a perspective view of a vehicle incorporating a window-mounted antenna system constructed in accordance with the principles of the present invention, showing the environment in which the system is used and the general location of the system.

The present invention, in its broadest sense, relates to improved window-mounted antenna systems for vehicles having mobile telecommunication transceivers therein and in a more refined sense, it relates to coupling devices used to interconnect conductive feedlines to a window-mounted antenna. FIG. 1 illustrates a conventional vehicle 20 with a body 21, a windshield 22 and an interior passenger compartment 23. The interior compartment 23 of the vehicle 20 includes a dashboard 24 that extends the width of the compartment 23 in front of the driver. The dashboard 24 may include a body portion 25 and a related molding 26 that fits between the windshield 22 and the dashboard body 25. The windshield 22 typically also includes a marginal glare-reducing border 28 of an opaque material that extends around the perimeter of the windshield 22.

Figure 2:
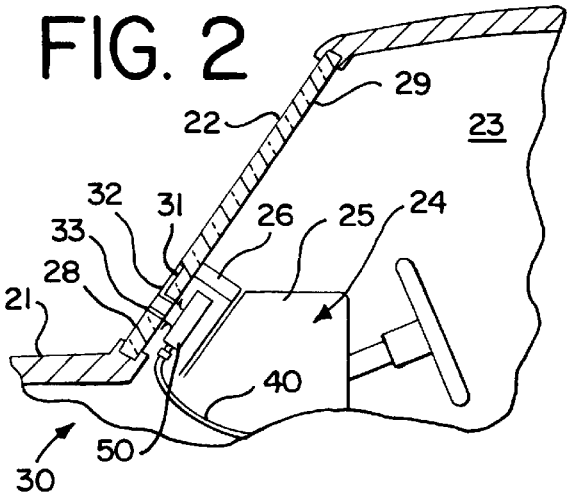
FIG. 2 is a cross-sectional view of the driver's side of the vehicle of FIG. 1, illustrating the window-mounted antenna radiators, the coaxial feedline and a coupler used to interconnect the two together in a location under the molding of the vehicle dashboard.

The vehicle 20 includes an internal telecommunication transceiver (not shown), such as a cellular telephone. The telephone may be of the style that is permanently mounted in the passenger compartment 23 or it may be a hand-held style telephone. In either instance, the vehicle 20 is provided with a window-mounted antenna system 30 constructed in accordance with the principles of the present invention. FIG. 2 illustrates the components of the system 30. The system 30 can be seen to include an antenna 31 having two antenna radiating elements or radiators 32, 33 with one 32 of the radiators being a horizontal element and the other 33 of the radiators being a vertical element. These radiating elements 32, 33 may be applied to the interior surface 29 of the windshield 22 in a conventional manner, such as by screen printing a conductive ink thereon, or alternatively, the radiating elements 32, 33 may be formed within the thickness of the windshield 22 in a known manner.

A conductive feedline 40 is provided to carry RF signals from the transceiver (not shown) to the antenna radiating elements 32, 33. Preferably, this conductive feedline 40 will take the form of a coaxial cable 42 (FIG. 3) which has an inner conductor 43 surrounded by a dielectric material 44 which in turn is surrounded by a second conductor, typically in the form of a metallic braid 45, that is covered with an insulative covering 46. The feedline 40 also preferably has a threaded connector 47 at its free end for connecting to a coupling device 50. The feedline 40 provides a conductive path from the transceiver to the dashboard location of the antenna 30.

Figure 3:
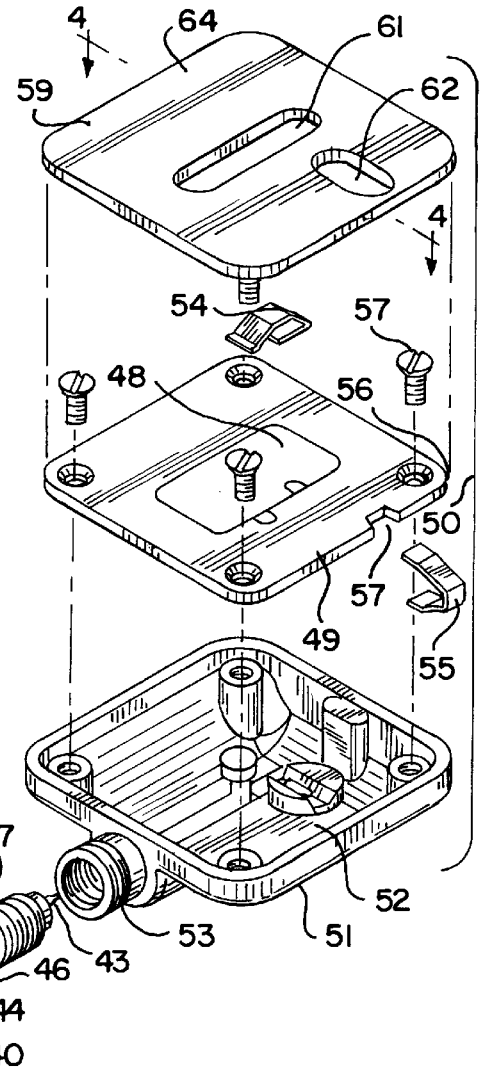
FIG. 3 is an exploded view of one embodiment of a coupling device utilized in the concealed, window-mounted vehicle antenna system of FIG. 1.
Figure 4:
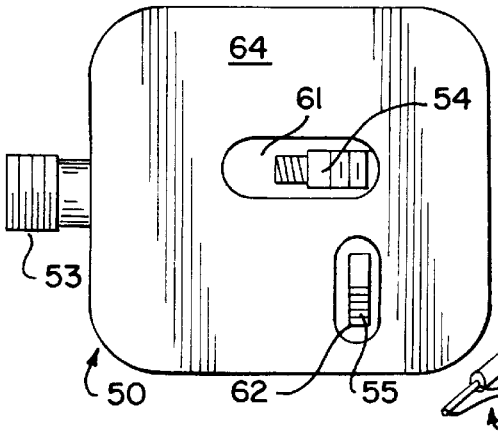
FIG. 4 is a plan view of the mounting surface of the coupling device of FIG. 3 taken along lines 4—4 thereof.
Figure 4:
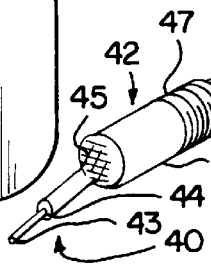

A coupling device 50 is provided as part of the antenna system 30 in order to provide a connection between the feedline 40 and the antenna 31. FIGS. 3 & 4 illustrate one embodiment of such a coupling device 50. As illustrated, the coupling device 50 includes a housing 51 with a hollow interior portion 52 and a threaded port 53 that is adapted to reliably engage the connector end 47 of the feedline 40. Two conductive contacts 54, 55 are provided and are respectively connected to the conductors 43, 45. A housing cover plate 56 of a dielectric material is provided to close off the interior portion 52 of the housing 51 and may be affixed thereto by way of screws 57 or other suitable fastening means. The cover plate 56 may have an inner conductive coating 48 formed thereon which is engaged by one of the contacts 54, while the other contact 55 extends through an opening 57 formed in the housing cover plate 56. The contacts 54, 55 extend from the housing 51 at a level where they will directly either contact the interior surface 29 of the windshield 22 or contact pads 34, 35 formed as part of the radiating elements 32, 33. The center contact 54 is the RF conductive contact and mates with the inner conductor 43 of the feedline 40, while the other contact 55 is the ground contact and engages the outer conductor 44 of the feedline 40 by engaging the coupling device housing 51. The ground contact 35 provides the ground potential to the ground radiator 32 through the grounded housing of the RF coupler device. The two contacts 54, 55 are separated by a non-conductive portion 49 of the housing cover plate In order to reliably attach the coupling device 50 to the windshield surface 29, an adhesive means is provided. In FIG. 3, this adhesive means is illustrated as a preformed layer 59 of adhesive material, such as double-sided adhesive tape. The adhesive layer 59 includes a pair of openings 61, 62 formed therein in alignment with the coupling device contacts 54, 55. Notably, the adhesive layer openings 61, 62 are formed within the perimeter 64 of the adhesive layer 59 so that the adhesive layer 59, in effect, entirely encompasses the coupling device contacts 54, 55, as illustrated best in FIG. 4. This encompassing effect is beneficial to antenna systems 30 of the present invention in that the coupler 50 provides a seal around the contacts 54, 55 to prevent environmental conditions, such as dust, oil or moisture, from detrimentally affecting the connection between the contacts 54, 55 and the radiating elements 32, 33.

Figure 5:
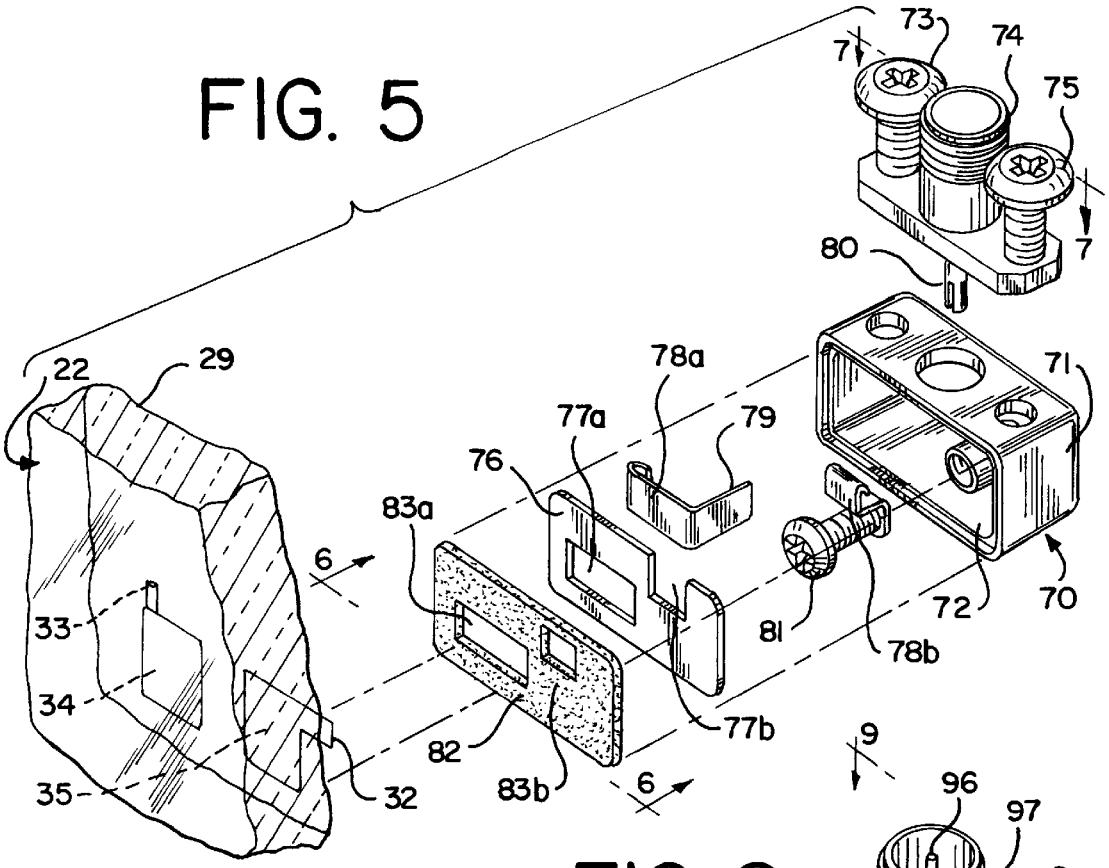
FIG. 5 is an exploded view of the antenna system of FIG. 1, incorporating a second embodiment of a coupling device.
Figure 6:
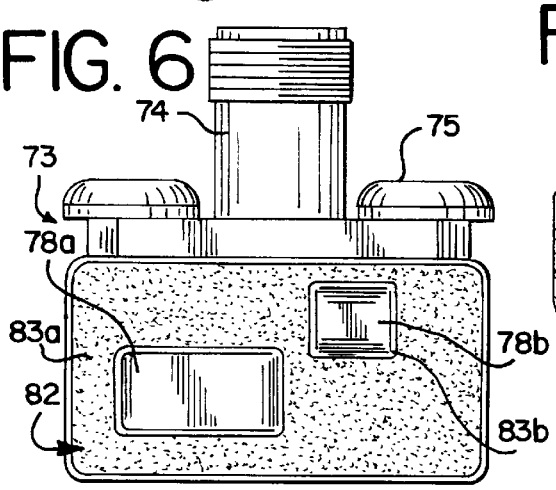
FIG. 6 is a front elevational view of the coupling device of FIG. 5 taken along lines 6—6 thereof.
Figure 7:
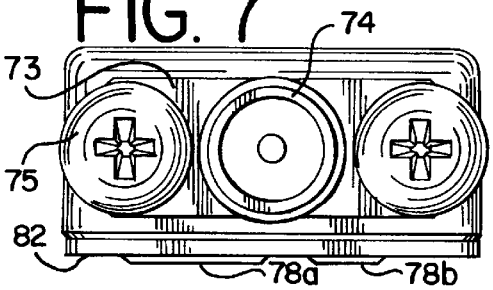
FIG. 7 is a top plan view of the coupling device of FIG. 5, taken along lines 7—7 thereof.

FIGS. 5–7 depict a second embodiment of a coupling device 70 particularly suitable for use with antenna systems 30 of the. present invention. The coupling device 70 of this embodiment is much reduced in its overall size and includes a metallic housing 71 with a hollow interior portion 72. A connector assembly 73 with a threaded coaxial connecting neck 74 is provided and may be attached to the coupler housing 71 by suitable means, such as screws 75. A cover plate 76 may be provided which has two openings 77*a*, 77*b* that permit passage therethrough of two coupler contacts 78*a*, 78*b*. One of the contacts 78*a*, the RF contact, has a prong 79 that engages a center conductor extension 80 of the connector assembly 73, while the grounding contact 78*b* engages the coupler housing 71 by way of a screw 81.

An adhesive layer, in the form of a double-sided pad 82, is provided to attach the coupling device 70 to the interior surface 29 of the windshield 22. The adhesive pad 82 has two openings 83*a*, 83*b* formed therein through which the contacts 743*a*, 78*b* extend. As with the first embodiment 50, the openings 83*a*, 83*b* of the pad 82 are contained within the outer perimeter of the pad 82 and preferably, the extent of the contacts 78*a*, 78*b* is such that they do not travel past the outer perimeter as well. This containment between the adhesive pad 82 and the contacts 78*a*, 78*b* in effect, seals the area around the connection. In this embodiment, wherein the antenna radiating elements 32, 33 are formed directly on the interior surface 29 of the windshield 22, the contacts 78*a*, 78*b* will directly touch the radiating element contact pads 34, 35. In this regard, it is preferred that the adhesive used for the pad 82 be suitably strong, such as a very-high-bond ("VHB") adhesive.

Figure 8:
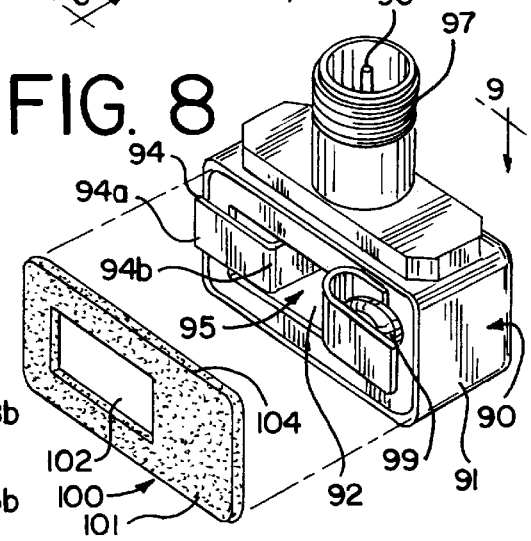
FIG. 8 is a partially exploded view of a third embodiment. of a coupling device used in antenna systems of the present invention.
Figure 9:
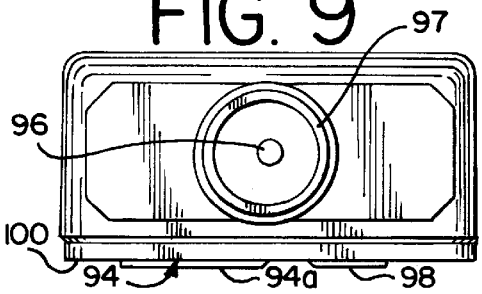
FIG. 9 is a top plan view of the coupling device of FIG. 8 taken along lines 9—9 thereof.

Referring now to FIGS. 8 and 9, a third embodiment of a coupling device 90 utilized in systems 30 of the present invention is illustrated. The coupling device 90 is preferably fabricated in a single piece, such as by casting which will eliminate the need for assembly screws, resulting in a more cost-effective manufacture of the RF coupling device 90. The coupling device 90 includes a hollow housing 91 having an opening 92 formed along a mounting surface 93 thereof. This opening permits the passage of a RF contact 94 therethrough. The RF contact 94 preferably has two prongs, or legs 94*a*, 94*b*, one leg 94*b* of which extends into the interior 95 of the housing 91 to make contact with the center conductor 96 of a threaded connector post 97. The other leg 94*a* of the RF contact 94 extends at an angle from the one leg 94*b* out of and away from the coupler mounting surface 93. A grounding contact 98 is attached to the coupler housing 91 by means of a screw 99 and extends away from and above the housing mounting surface 93.

The coupling device 90 further includes an adhesive layer 100, illustrated as a preformed pad 101 having an opening 102 therein within its outer perimeter 104. As seen in FIG. 9, the adhesive layer 100 has an extent to entirely contain the contacts 94, 98 of the coupler 90 within its perimeter 104 for providing an effective attachment to the inner surface 29 of the windshield 22 as well as a seal around the coupler antenna contacts 94, 98.

It is preferred that the contacts used in the coupling devices described above be of a highly conductive material, such as a beryllium copper (BeCu) alloy. The sizes of the couplers described above are small and may be significantly less than the size of the antenna 31, i.e., less than 3 inches by 3 inches. This reduced size permits the couplers and the antennas of the present invention to be advantageously concealed from exterior view.

While the preferred embodiment of the invention has been shown and described, it will be apparent to those skilled in the art that changes and modifications may be made therein without departing from the spirit of the invention, the scope of which is defined by the appended claims.

We claim:

1. An RF coupler for use in a mobile telecommunication system for a vehicle wherein the vehicle includes a window-mounted antenna having at least two radiating elements thereon, the coupler providing a connection between the window-mounted antenna and a telecommunication device located in an interior compartment of the vehicle, said coupler comprising:

a housing having a hollow interior and a mounting surface for mounting to an opposing surface of said windshield, a port for engaging a feedline extending from the coupler housing interior to exterior of said coupler housing, the housing mounting surface having a pre-selected outer perimeter, said port interconnecting the telecommunication device and the antenna;

a pair of first and second antenna contacts extending outwardly from said coupler housing over said mounting surface;

said first contact providing an electrical connection between a center conductor of said feedline and an RF radiating element of said antenna, and the second contact providing an electrical connection between another conductor of said feedline and a ground radiating element of said antenna;

an adhesive layer disposed on said housing mounting surface for attaching said coupler to said windshield opposing surface, the adhesive layer having an outer perimeter that approximates said housing mounting surface outer perimeter, said first and second coupler antenna contacts being encompassed entirely within said adhesive layer outer perimeter, whereby said adhesive layer affixes said housing to said windshield and provides a seal around the coupler first and second antenna contacts.

2. The RF coupler of claim 1, wherein said adhesive layer includes at least one opening disposed therein and encompassed within said adhesive layer outer perimeter.

3. The RF coupler of claim 1, wherein said adhesive layer includes at least one opening disposed therein and said adhesive layer is encompassed within said housing mounting surface outer perimeter.

4. The RF coupler of claim 1, wherein one of said first and second antenna contacts extends from said housing hollow interior through an opening formed in said housing mounting surface.

5. The RF coupler of claim 1, wherein said housing includes a cover plate and said cover plate defines said housing mounting surface, said cover plate including at least one opening formed therein and one of said first and second antenna contacts extends from said hollow interior through said cover plate opening and over said adhesive layer.

6. The RF coupler of claim 5, wherein the other of said first and second antenna contacts is mounted in contact with said housing mounting surface.

7. The RF coupler of claim 5, wherein said other of said first and second antenna contacts engages said housing cover plate.

8. The RF coupler of claim 1, wherein said housing mounting surface includes a dielectric layer interposed between said adhesive layer and said housing hollow interior.

9. The RF coupler of claim 1, wherein said adhesive layer includes first and second openings disposed therein and said first and second antenna contacts respectively extend outwardly from said housing through said adhesive layer first and second openings.

10. The RF coupler of claim 1, wherein said antenna contacts are formed from a beryllium-copper alloy.

11. The RF coupler of claim 1, wherein said feedline engagement port includes a threaded connection to engage said feedline.

12. The RF coupler of claim 1, wherein said housing includes an opening disposed in said mounting surface thereof that communicates with said housing hollow interior, said first antenna contact being connected to said feedline engagement port within said housing hollow interior and said second antenna contact being connected to said housing mounting surface, each of said first and second antenna contacts extending from said coupler and over said adhesive layer.

13. The RF coupler of claim 1, wherein said housing and said port are formed in one piece.

14. The RF coupler of claim 13, wherein said first and second radiating elements each have a contact pad formed on the interior surface of the windshield being secured to said first and second antenna contacts of said coupler.

15. The RF coupler of claim 1, wherein said first and second window-mount radiating elements are disposed within the windshield of the vehicle.

16. The RF coupler of claim 1, wherein said radiating elements are disposed on the interior surface of the windshield of the vehicle.

17. The RF coupler of claim 1, wherein said coupler is adhesively secured to the interior surface of the windshield such that it is not visible from the exterior of the vehicle.

18. An antenna for use with a mobile telecommunication system disposed within a vehicle, the vehicle having an interior compartment, a dashboard and a windshield defining a portion of said interior compartment, the dashboard and windshield being located proximate to each other, the telecommunication system including a telecommunications device with a feedline, said antenna comprising: a pair of antenna radiating elements formed along a portion of said windshield proximate to said dashboard, a coupler for providing a connection between said feedline and said radiating elements, the coupler being mounted to said windshield in alignment with said radiating elements, said coupler including a housing having a portion for engaging said feedline, said coupler further including first and second contacts extending therefrom for contacting said radiating elements; and said coupler further including an adhesive disposed on a surface thereof in a manner that encompasses said first and second contacts.

19. The antenna of claim 18, further having a molding interposed between said windshield and dashboard providing an area concealed from view beneath the molding and said coupler is mounted to windshield beneath said molding.

20. The antenna of claim 18, wherein said antenna radiating elements are embedded within the windshield.

21. The antenna of claim 18, wherein said antenna radiating elements are disposed on the interior surface of the windshield.

22. The antenna of claim 18, wherein said pair of antenna radiating elements include a corresponding pair of pads at terminal ends thereof, providing contacts with said coupler.

23. The antenna of claim 18, wherein said coupler housing includes a planar mounting surface with said adhesive being deposited on said mounting surface.

* * * * *